US006514324B1

(12) United States Patent
Chapman

(10) Patent No.: US 6,514,324 B1
(45) Date of Patent: Feb. 4, 2003

(54) HIGH EFFICIENCY ACTIVE ELECTROSTATIC AIR FILTER AND METHOD OF MANUFACTURE

(76) Inventor: Rick L. Chapman, 2159 Palma Dr., Suite C, Ventura, CA (US) 93003

( * ) Notice: Subject to any disclaimer, the term of this patent is extended or adjusted under 35 U.S.C. 154(b) by 0 days.

(21) Appl. No.: 09/927,291

(22) Filed: Aug. 10, 2001

(51) Int. Cl.[7] ..... B03C 3/28

(52) U.S. Cl. ..... 96/67; 55/486; 55/521; 55/524; 55/528; 55/DIG. 5; 55/DIG. 39; 95/59; 96/69; 264/484; 264/DIG. 8; 264/DIG. 48; 442/414

(58) Field of Search ..... 96/15, 17, 69, 96/66, 67, 99, 98; 95/59, 61; 55/524, 521, 528, 486, 488, 497, DIG. 5, DIG. 39; 442/414; 264/484, DIG. 8, DIG. 48

(56) References Cited

U.S. PATENT DOCUMENTS

| | | | | |
|---|---|---|---|---|
| 4,215,682 A | | 8/1980 | Kubik et al. | 128/205.29 |
| 4,239,973 A | | 12/1980 | Kolbe et al. | 250/531 |
| 4,375,718 A | | 3/1983 | Wadsworth et al. | 55/DIG. 39 |
| 4,513,049 A | | 4/1985 | Yamasaki et al. | 428/194 |
| 4,534,918 A | | 8/1985 | Forrest, Jr. | 264/22 |
| 4,588,537 A | | 5/1986 | Klasse et al. | 264/22 |
| 4,592,815 A | | 6/1986 | Nakao | 204/165 |
| 4,626,263 A | | 12/1986 | Inoue et al. | 55/DIG. 39 |
| 4,874,659 A | | 10/1989 | Ando et al. | 428/221 |
| 4,904,174 A | | 2/1990 | Moosmayer et al. | 425/174.8 E |
| 4,997,600 A | | 3/1991 | Okumura et al. | 264/22 |
| 5,051,159 A | | 9/1991 | Deeds | 425/174.8 E |
| 5,112,677 A | * | 5/1992 | Tani et al. | 55/DIG. 39 |
| 5,401,446 A | | 3/1995 | Tsai et al. | 361/225 |
| 5,411,576 A | | 5/1995 | Jones et al. | 95/57 |
| 5,419,953 A | * | 5/1995 | Chapman | 96/17 X |
| 5,472,481 A | | 12/1995 | Jones et al. | 96/15 |
| 5,554,722 A | | 9/1996 | Eichenauer et al. | 528/180 |
| 5,558,809 A | | 9/1996 | Groh et al. | 252/62.54 |
| 5,610,455 A | * | 3/1997 | Allen et al. | 96/99 X |
| 5,645,627 A | | 7/1997 | Lifshutz et al. | 96/15 |
| 5,726,107 A | | 3/1998 | Dahringer et al. | 442/414 |
| 5,830,810 A | * | 11/1998 | Cohen | 55/524 X |
| 5,837,022 A | * | 11/1998 | Chapman | 55/497 X |
| 5,871,845 A | | 2/1999 | Dahringer et al. | 428/378 |
| 5,900,305 A | * | 5/1999 | Chapman | 442/392 X |
| 5,935,303 A | * | 8/1999 | Kimura | 96/69 |
| 5,976,208 A | * | 11/1999 | Rousseau et al. | 55/DIG. 5 |
| 6,056,809 A | * | 5/2000 | Chapman | 96/67 |
| 6,056,860 A | | 5/2000 | Amigo et al. | 204/454 |
| 6,110,251 A | * | 8/2000 | Jackson et al. | 55/528 X |
| 6,238,466 B1 | * | 5/2001 | Rousseau et al. | 96/15 |
| 6,322,615 B1 | * | 11/2001 | Chapman | 264/DIG. 48 |

FOREIGN PATENT DOCUMENTS

| | | |
|---|---|---|
| EP | 245108 | 11/1987 |
| EP | 305620 | 3/1989 |
| GB | 1493183 | 11/1977 |

* cited by examiner

*Primary Examiner*—Richard L. Chiesa
(74) *Attorney, Agent, or Firm*—Marvin E. Jacobs

(57) ABSTRACT

A washable air filter for removing particles from the inlet air to a heating and/or air conditioning system formed of an assembly of a central polymeric pad containing actively charged charge control agents of a first polarity, a polymeric net containing a dispersion of charged charge control agents of a second polarity in the polymer on each side of the pad and a stiff, deformable metal or plastic grill on each side of the net to form an assembly which can be corrugated and placed in a perimeter frame. The charging is preferably accomplished as the assembly passes over the surface of a roller with a conductive surface.

16 Claims, 5 Drawing Sheets

HIGH EFFICIENCY ACTIVE ELECTROSTATIC AIR FILTER AND METHOD OF MANUFACTURE

TECHNICAL FIELD

This invention relates to filters cleanable by washing or vacuuming or the like for inlet air heating and air conditioning systems used in residential or commercial buildings and, more particularly, this invention relates to a washable electrostatic filter for such systems having an extended service life and improved efficiency.

BACKGROUND OF THE INVENTION

Inlet air filters for heating and air conditioning systems have been in use for decades. The inlet air or primary filter was originally intended to protect the heating coils and mechanical devices such as fans from damage by airborne particles. As the harmful effect of inhaled particles on human health became known, inlet air filters were designed to remove this particulate matter from the air.

The most popular prior art configuration is a thin, rectangular, disposable filter. The filter contains fiberglass, animal hair, fibrous foam or polymeric media or aluminum mesh encased in a cardboard or plastic frame. Prior art filters comprised polyester panels, urethane foam or latex coated animal hair. Recently, prior art filters containing static or passive electrostatic media have become available. Most residential resistance specifications require air filters to have an initial pressure drop of no more than 0.22 inches of water for an airflow rate of 300 feet per minute. The dust spot efficiency for typical prior art air filters tested using ASHRAE 52.1-1992 is 20% or less. The ASHRAE efficiencies of four types of commercially available filters follow:

TABLE 1

| Filter Type | Area of Media Square Feet | ASHRAE Efficiency |
|---|---|---|
| Fiberglass Throwaway | 4.0 | <20% |
| Electrostatic (Passive) | 4.0 | 20% |
| Electrostatic (Fibers) | Up to 8.9 | 30% |
| Pleated Polyester Blend | Up to 6.0 | 25% |
| Minipleat | Up to 6.4 | 45% to 65% |

When these filters are first placed in use across an air stream, they have a very low filtering efficiency. Typically, the exhaust or dust spot efficiency is about 8%. However, as dust particles are collected, the dust collection efficiency can increase to approximately 20%. At this point, the filter is ready to be replaced. Prior art filters are usually difficult to clean since the dust particles become embedded in the media.

Another current concern is the recognition that particles below 10 microns are not filtered by the cilia hairs in the nose and are therefore inhaled into a human lung. Fibrous particles such as asbestos and fiberglass are known to cause respiratory diseases. Most current inlet air filters for heating and air conditioning systems are not very efficient in capturing these small particles. Filters containing layers of electrostatic media perform better within this range of particles but these filters also become clogged. Since they cannot be efficiently cleaned they must be replaced.

U.S. Pat. No. 6,056,860 disclosed that pleating a washable electrostatic filter resulted in increased efficiency. Capture of particles was enhanced by the angle of approach to the pleated media and by the use of passive electrostatic netting in the multi-layer media. An electrostatic field is only present when air flows past the passive netting and induces charge on the surface of the netting.

The next generation of electrostatic type filter requires an efficiency boost, without increasing the amount of pressure it takes to push the air through the filter medium. Today, passive electrostatic filter medias work mainly on the principal of friction and inherent static electricity in the polymer to obtain their efficiencies. A company that manufactures static control equipment has stated that, contrary to popular belief, static electrification is never caused by just an air flow hitting a solid surface. In most cases, the filters contain layers of a polypropylene honeycombed netting, typically woven, formed from non-woven extruded, monofilament approximately 0.01 diameter and a central layer of a urethane foam or a high loft polyester which also contains some inherent static charges. In the more efficient static charged fiber filters, each fiber has both positive and negative charges. These fibers are 3 to 30 denier in size, or approximately 0.00049 to 0.00268 in. diameter. And usually these types of filters are expensive and are of a disposable type lasting about three months. These filters are known as an "Electret type" having efficiencies of approximately 34% dust spot.

The next generation of washable filters requires an increase in efficiency without increasing the pressure drop across the filter.

STATEMENT OF THE INVENTION

The efficiency of washable filters is further improved in accordance with this invention by adding active electrostatic materials to the polymeric netting, and/or central filter material and/or to the adhesive binder resins used to bond the fibers of the central filter layer of the filter. Preferred active electrostatic materials are charge control agents. The filters of the invention can have a flat or pleated configuration. Pleated filters result not only in increased efficiency but also lower initial resistance to flow. The life of the filter between cleanings is substantially increased and cleaning the filter is much easier. Another aspect of the invention is method and apparatus for forming and charging multiplayer washable filter media containing charge control agents.

In the filter of the invention, charge is not only induced on the surface of the netting or central layer, but is present throughout the bulk of the polymer fibers in the netting or the polymer fibers or foam in the central layer. The polymers are preferably non-conductive and contain from 0.5% to 15% preferably 1 to 10 percent by weight of the charge control agents. The polymers must have high melting and decomposition temperatures to survive the compounding, charging, pleating and other steps of manufacturing the filters. Suitable polymers are polyalkylene polymers having 2–6 carbon atoms such as polyethylene and polypropylene, linear polyamides such as Nylon®, polycarbonates, and polyurethanes. Polar polymers containing negative charge agents such as acrylic polymers, polymethacrylic acid or alkyl esters thereof, acrylic copolymers such as styrene-methylmethacrylate may be utilized.

Examples of charge control agents are compounds of organic or organometallic charge control compounds, inclusions compounds of cyclic polysaccharides, monoazo metal compounds, alkyl acrylate monomers, alkyl methacrylate monomers, calixarene compounds metallized with an alkali metal or an alkaline earth metal, rhodamine or xanthene-type dyes, polytetrafluoroethylene, alkylene, arylene, arylenealkylene, alkylenediarylene oxydialkylene or oxydiarylene polyacrylic and polymethacrylic acid compounds, organic titanates, quaternary phosphonium trihalozincate salts, organic silicone complex compounds, dicarboxylic acid compounds, cyclic polyethers or non-cyclic polyethers, cyclodextrin, complex salt compounds of amine derivatives, ditertbutylsalicicyclic acid, potassium tetaphenylborates, potassium bis borates, sulfonamides and metal salts thereof, alumina particles treated with silane coupling agents selected from the group consisting of dimethyl silicone compounds, azo dye, phthalic ester, quaternary ammonium salt, carbazole, diammonium and triammonium, hydrophobic silica and iron oxide, phenyl, substituted phenyl, naphthyl, substituted naphthyl, thienyl, alkenyl and alkylammonium complex salt compounds, sodium dioctylsulfosuccinate, sodium benzoate, zinc complex compounds, mica, monoalkyl and dialkyl tin oxides and urethane compounds, metal complex of salicyclic acid compound, oxazolidinones, piperazines, perfluroinated alkanes, fatty acid amides, oleophobic fluorochemical surfactants, Lecigran MT, nigrosine, fumed silica, carbon black, para-trifluoromethyl benzoic acid and ortho-fluoro benzoic acid, poly(styrene-co-vinylpyridinium toluene sulfonate), methyl or butyltriphenyl phosphonium-p-toluene sulfonate, complex aromatic amines, triphenylamine dyes and azine dyes, alkyldimethylbenzylammonium salts.

The charge control agents ("CCA"s) operate by triboelectric charging of particles. In general, optimum concentrations of particles are 0.5–65% by weight and effects are superior when CCAs are uniformly dispersed in the adhesive.

A. A lecithin derivative—LECIGRAN MT results in a (+) charge if the contact is a conductor and a (−) charge if the contact is resistive. A recommended polymer is a styrene-methylmethacrylate copolymer. Since this material would be close to the middle of the triboelectric series, it appears that the lecithin merely enhances the ability of the material to either donate or accept electrons depending on the resistivity of the other half of the triboelectric couple. Lecithin and other derivatives are commonly available chemicals.

B. Nigrosine and its derivatives are unusual in that they tend to result in negative polarity charging at low concentrations. They also are readily available commercially.

C. Fumed silica can be hydrophilic or hydrophobic. In the former state it imparts high negative charges to copolymers such as styrene-butylmethacrylate. Even higher negative charges would be expected in polyethylene and polypropylene because of their more negative position in the triboelectric series. Moderate relative humidity variations should not affect the electrostatic charge significantly. Cabot Corporation is one of the principal manufacturers of fumed silica and other silicas.

D. There is an increasingly popular theory that triboelectric charging is due to the transfer of ions from one surface to another. Materials like polyacrylic and polymethacrylic acids, poly (styrene-co-vinylpyridinium toluene sulfonate), methyl or butyl triphenyl phosphonium-t-toluene sulfonate (Eastman Chemical), complex aromatic amines, some quaternary ammonium salts, triphenylamine dyes and azine dyes are all charge control agents. It has been shown that when the bulkiest part of the CCA molecule or polymer is a cation, the resulting triboelectric charge is (+). Conversely, when the bulkiest part of the CCA material is an anion the triboelectric charge is (−). The small counterion transfers to the other triboelectric material producing the opposite polarity charge. Therefore acids, complex amines, several dyes, and quaternary ammonium salts charge positively; while sulfonates, whether polymeic or not, and similar compounds charge negatively. Hodogaya Chemical Company, LTD produced materials used specifically to control charge magnitude and polarity. Several other chemical companies make materials that can serve the same purpose.

E. Slightly conductive particles at low enough concentrations such that there is little or no particle to particle contact can acquire high triboelectric charges. Carbon blacks are a good example. One variety is an oxidized, acidic carbon black, which tends to acquire a negative charge. Unoxidized carbon black, on the other hand, when dispersed in the same polymer, acquires a positive charge. Thus, it may be possible to use only one polymer micro-fiber and control charge polarity with different CCAs. Such an approach could lead to substantial material production and processing cost savings.

F. Hodogaya Chemical Company, LTD appears to have a rather substantial research program on innocuous CCA materials. This company reports that benzoic acid derivatives are effective charge control agents. Para-trifluoro methyl benzoic acid produces very high (+) charges but ortho-fluoro benzoic acid yields the highest (−) charges.

The filter of the invention is optimally angled to capture particles. It can be cleaned by shaking, vacuuming and/or by washing. The media has low-pressure drop and high efficiency for the range of particles experienced with the inlet air. Because it can be cleaned and reused, the filter of the invention can be considered a active filter.

Other advantages of the media of the invention is the use of thinner central layers 0.1 to 0.5 inches thick with higher surface area and pleating density suitably up to 5.0 square foot area and up to 20 pleats per foot. It is also preferred that the netting contain the opposite charge to the adjacent central layer.

These and many other features and attendant advantages of the invention will become apparent as the invention becomes better understood by reference to the following detailed description when considered in conjunction with the accompanying drawings.

DETAILED DESCRIPTION OF THE INVENTION

Figure 1:
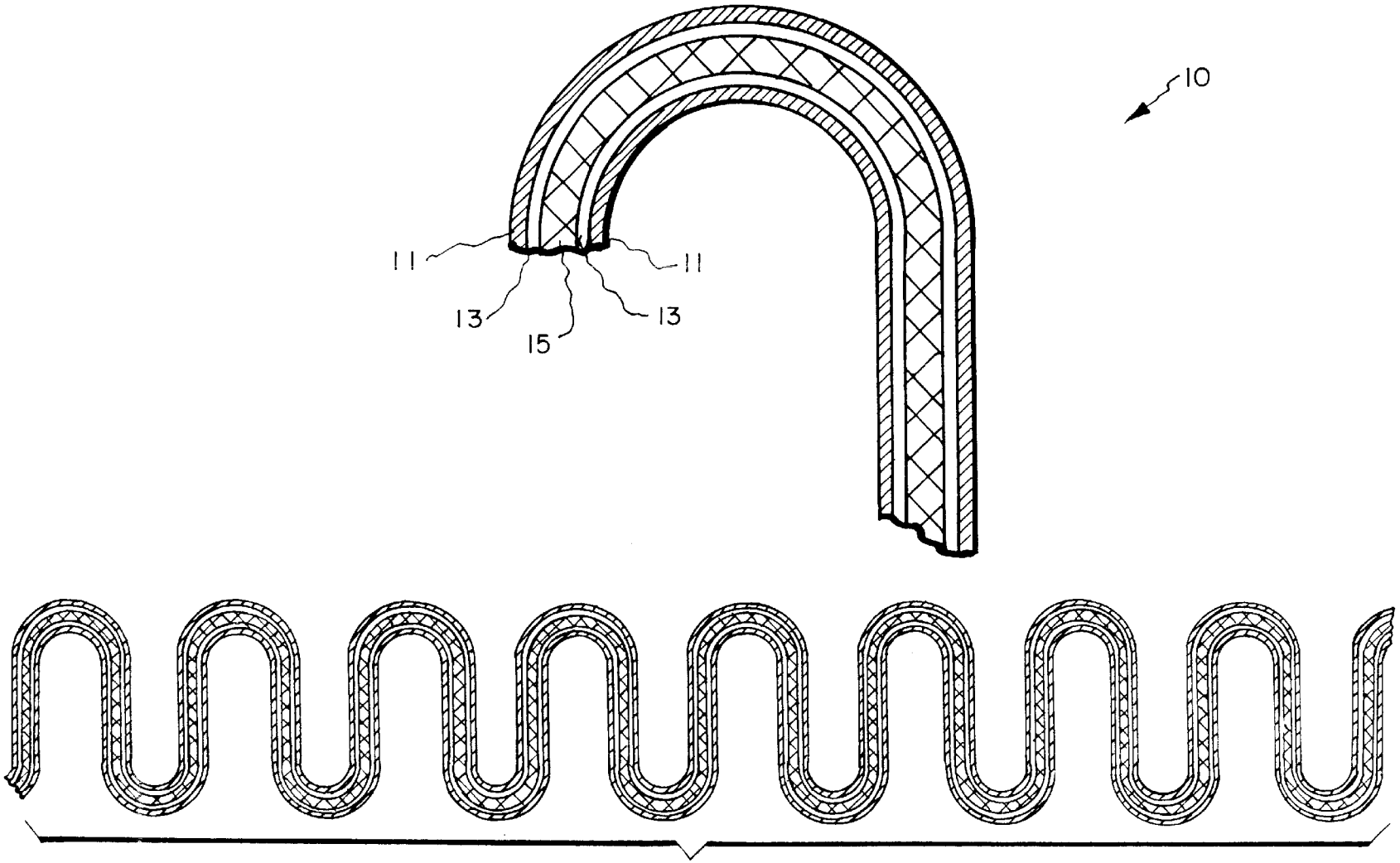
FIG. 1 is a view in section of a corrugation of a first embodiment of the filter of the invention.

The active electrostatic filter contains a core layer of a bendable material, from 0.05 to 0.45 inches in thickness selected from polymeric foam or a high loft fibrous polymeric material such as air laid polyester fibers having a density of from 0.5 to 5 ounces per square yard (OPSY). The fibers are resin bonded by a resin such as an acrylic resin or point bonded or needle, bonded. In a preferred embodiment the central or core layer is comprised of a thermoset material. This material removes most of the particles from the air stream, typically at least 80% of the incoming particles having sizes up to 10 microns.

The particle capture efficiency of the core material is enhanced by placing a layer of passive or active electrostatic polymer material on each side of the core material. The material can be woven or non woven. Passive electrostatic materials are used which become charged as air flows past the polymers that tend to have natural static charges. Active electrostatic materials contain charge control agents. These are preferred since the available active electrostatic fibrous materials produce an undesirably high-pressure drop as a filtration media and are not cleanable. The material is usually formed by casting, extrusion or weaving from a polymer of a nonsaturated alkene monomer having 2–8 carbon atoms. One type of material is woven polypropylene netting having a thickness from 0.01 to 0.10 inches, usually from 0.02 to 0.06 inches. The yarn diameter can be from 1–35 denier, preferably from 5–20 denier. The ratio of warp to fill yarn is from 1.2/1 to 3/1 and the netting is woven in a manner to resemble a honeycomb structure. A commercially available material is a honeycomb weave netting of 8 mil thick polypropylene fibers available in thicknesses of 0.03 and 0.05 inches. The yarn count is 51 warp and 32 fill.

The outside grill layer does not contribute to filtering but is present to hold the angled media after it has been formed. Again, the layer must be capable of being easily bent or deformed during the assembly process. If the sheet of material is too thick it is difficult to bend and if it is too thin, it is not capable of holding the 3 layer media in its bent shape. Expanded metal such as steel or aluminum having a thickness from 0.010 to 0.25 inches, performs satisfactorily in the filter of the invention. The most preferable gage thickness is dependent upon the size of the air filter. Larger air filters will require a more sturdy or heavier gage grill. The expanded metal grill should have open area of at least 70%. Open area can be provided by thin strands from 0.01 to 0.18 in thickness expanded to rectangular or parallelogram openings having an area of at least 0.5 square inches.

Two Layer Embodiment. A filter media will be comprised of fibers of a plastic material such as polyester or polypropylene nylon held together with binder, preferably an acrylic thermosetting binder. The filter media is selected from material which can capture in excess of 80% of particulate matter of 10 micron or less in size. The filter media layer is preferably made from polyester having 0.1 to 40 Denier fibers, usually 6–15 Denier fibers, an acrylic resin binder preferably containing an antimicrobial agent. The media may contain a curable resin such as a thermosetting, light cured or water activated resin. The resin may be dispersed throughout the media as applied as stripes to the media at locations corresponding to the tops of the pleats, before or after pleating, preferably after pleating. The resin is then cured to a rigid state to hold the pleats in shape. Such a thermal-set filter media, in combination with an electrostatic layer can be corrugated without the need of metallic grills to maintain the corrugated shaper. The desired electrostatic layer can be described as a netting material. The electrostatic layer may be made from media such as polypropylene, polyester, nylon or polycarbonate. More preferably, the electrostatic layer is made from DEL-NET RB0404-12P, a product of Applied Extrusion Technology, Middletown, Del. or Equiliuent. In use, the air filter would be installed with the electrostatic layer facing upstream. In this embodiment, stitching, stapling, thermal welding, adhesives or other means could be utilized to attach the filter media and electrostatic layer to one another. Additionally, a second electrostatic layer may be disposed on the downstream side of the filter media to increase the filter's efficiency.

Five Layer Embodiment. In this configuration, either side of the filter can be placed upstream.

This embodiment has a central filter media layer from the same material as described above although it is not required to have a thermal-setting property.

Disposed on either side of the central layer is an active or passive electrostatic layer of the same material described earlier. Disposed on the outward facing surface of each electrostatic layer is a grill, suitably formed of expanded metal. The grill is preferably made of metal. Most preferable, the grill is made from a non-corrosive material such as aluminum or galvanized steel. A non-metallic material may also be utilized as a grill. The purpose of the grill is to provide a deformable material which will cause the filter, once corrugated, to maintain its corrugated shape. The grill layers are required when a resilient filter media is used which will tend to return to a flat shape.

The exterior layers on either side of the air filter media are comprised of expanded aluminum or galvanized steel having a thickness of 0.015 inches and strand thickness of about 0.04 inches. The rectangular openings were 1.5×01.75 inches.

The passive electrostatic layers adjacent each exterior layer is comprised of polypropylene netting having a thickness of 0.03 inches, warp and fill yarn diameters of 8 mil, a weight of 3 oz/yard and a yarn count of 51 warp yarns per inch and 32 fill yarns per inch. The active electrostatic layer contains 5% by weight of CCA.

The center layer disposed between the electrostatic layers is a polyurethane foam or high loft polyester having the following properties:

| | |
|---|---|
| Weight (ounces per square yard): | 4.5 +/− 10% |
| Gauge (inches) | 0.25 +/− 5% |
| Fiber Content: | Polyester (6 & 15 Denier) |
| Binder Type: | Acrylic Latex (solids 38%) |
| Porosity (cfm/Ftsg. @ 0.5 WG): | 740 cfm |
| Color: | White |
| Texture: | Stiff/Lofty |
| Antimicrobial: | Aegis or Equiliuent |

An active central layer contains 59% by weight of a CCA.

The active netting can contain an additive of a negative charge control agent such as PTFE powder, polyvinylidene fluoride, acrylic ultra fine powder, titanium dioxide and fumed silica.

The netting can contain an additive of a negative charge control agent such as PTFE powder, four micron particles, polyvinylidene fluoride, a crystalline high molecular weight polymer of vinylidene fluoride, exhibits high dielectric strength. Acrylic ultra fine powder, 0.4 micron hydrophobic particles that exhibit high surface area. Titanium dioxide, high surface, BET 35–65 meters per square gram. Fumed silica, treated with a dimethyl silicone fluid. Extremely hydrophobic and high in surface area, BET, 100 square meters per gram.

The center material can contain an additive in its adhesive binder containing a positive charge control agent consisting of: oxide, BET surface area 85 to 115 square meters per gram. Thirteen micron particles. Polyacrylic acid, a low molecular weight water solution, fumed silica with alpha-aminopropyltriethoxysilane, polyquaternary ammonium polymers, hydrophilic containing many ionic charge transfer sites. Copolymers of vinylimidazolium methachloride and vinylpyrrolidone, a water miscible polymers of varying cationicity, containing many ionic charge transfer sites, quaternized vinylpyrrolidone/dimethylaminoethylmethacrylate copolymer, a water miscible polymers of varying cationicity, containing many ionic charge transfer sites. Cross linked polymethacrylate resin, acrylic ultra fine powder, 0.4 micron hydrophobic particles that exhibit high surface area. Low-molecular weight, cationic polyacrylamide of approximately 40% concentration. Silica acrylate complex, excellent in resilient property. Amorphous silica with 1 to 1.5 microns particle size.

The center material can contain an additive in its adhesive binder containing a positive charge control agent such as: a metal oxide with or without a silazane treatment such as aluminum oxide. Other agents include polyacrylic acid, fumed silica heated with alpha-aminopropyltriethoxysilane, polyquaternary ammonium polymers, copolymers of vinylimidazolium methochloride and vinylpyrrolidone, quaternized vinylpyrrolidone/dimethylaminoethylmethacrylate copolymer, cross-linked polymeth-acrylate resin, acrylic ultra fine 0.4 to 2.0 micron powder, low-molecular weight (2000 to 4000) cationic polyacrylamide and water soluble silica acrylate complex.

EXAMPLE 1

Active netting is polypropylene compounded to contain a uniform dispersion of 5% by weight of silica to provide a negative charge.

The central layer is a fibrous polyester material bound together with an acrylic binder containing 5% of polyacrylic acid to provide positive charge.

Electrostatic composite filters are formed by a special method according to the invention and the efficiencies achieved demonstrate that both shape and additives can enhance all of the filtering techniques, the dust holding capacity and lower the initial pressure loss. A novel apparatus is provided to form the walls of the corrugation by a method similar to a corrugator. After the walls of the corrugations are formed will enter a buncher that will space the corrugations. The corrugations provide more filter medium per square foot of filter area. This is necessary to accommodate the special higher resistance, active electrostatically charged special blend of fiber media that provide high efficiency performance. Most filters operate at low efficiencies by straining alone until enough dust is captured to start filtering smaller particles that can be deposited within the respiratory system. Electrostatic filters combine a higher efficiency mechanical type media with a highly charged electrostatic polymer netting in controlling the path of the air flow and the mechanics of capturing particles to effect the overall filter performance. By controlling the profile on-predetermined centers and the angle of the walls of the preferred corrugations, the radius at the top of the corrugation and the angle at the bottom of the corrugation will cause diffusion of the airflow and the air pressure over the corrugated filter surface. At the start of the life of the filter and throughout its life the air follows the path of least resistance to pass through the filter. At first the air flows through the bottom and the top of the corrugation. The air does not change its direction of flow and the particles begin to be filtered out. The inside round shape at the bottom of the corrugation is compressed at the center layer and has a higher resistance to air flow. This will accomplish two things. One, the airflow will be diffused somewhat which changes the direction of the airflow. Also the compression will provide the media with a slight increase in efficiency. A build-up of dust and allergen sized contaminants causes an increase in resistance at the bottom and top of the pleat enhancing the mechanical filtration. The airflow then gradually moves up the sidewalls, as the filter becomes loaded with dust and sub micron size particles. The large size particles traveling at a high velocity and inertia forces a large majority of the large particles to the bottom of the corrugations. The build-up of the larger sized particles starts to filter sub micron sized particles thus making the filter more efficient at the bottom of the corrugation. As the filter loads the efficiency of the upper wall particles increase. After the bottom of the corrugation starts to fill with dust the air must change directions to find its path of least resistance. As this occurs other methods of filtration start becoming more effective. All of the filtration principles except straining will become enhanced. At the bottom of the pleat straining and in the case of the electrostatic filter, electrostatic deposition (due to more dwell time) will both be enhanced. After this air makes a change in direction the air follows a more tortuous path enhancing the impaction and interception processes in the capture of both larger and smaller particles. Diffusional effect is always present in capturing sub micron particles because it is unaffected by airflow. The corrugated composite is achieved by a multilayer process and can be controlled to achieve the efficiency and airflow required. The upper radius and the V in the bottom both allow for smooth air flow through the filter and a lower initial pressure loss. The V also contributes to the easier cleaning of the filter.

The filters of the invention can contain from two to five layers. One or two of the outside layers could be an expanded metal or a porous plastic; this allows the forming of the walls and the preselected radius creating the controlled spacing between the corrugations. One or two of the layers can be an active or passive electrostatic polymer netting, typically polypropylene, and the third or middle can be a bendable foam or a special blend of 0.1 denier to 40 denier fibers of polyester. This web can have enhanced charge agents added to the fiber bonding material. The corrugating step can be described more as a corrugation than a pleating. In this invention the composite medium will be formed with two rollers with fingers machined or welded to the rollers that will corrugate the composite layers in the desired profile. The corrugated layers then proceed through a bunching process to compress and/or space the walls to the desired number, and/or slant of the walls, and corrugations per foot.

EXAMPLE 1

A standard acrylic adhesive binder resin was mixed with 10 percent fumed silica to form a uniform suspension in water. The suspension was then mixed with 6 and 15 denier fibers 2.5 ounces/sq.yd. and dried to form a resin bonded, silica filled sheet. The sheet was charged with a cold charging apparatus to approximately 1,000 volts. 10 days after the charge the charge state of 1,000 volts positive charge was maintained, as tested with a Volt Meter.

EXAMPLE 1A

Acrylic adhesive binder was mixed with the same amount of fiber as Example 1 and dried to form a sheet. Fractional efficiency testing was conducted at 140 feet/minute media velocity.

| Efficiency Percentages | | |
|---|---|---|
| Micron Size | Charged Media Example 1 | Uncharged Media Example 1A |
| .3 | 3.7 | 2.6 |
| .5 | 12.2 | 10.3 |
| .7 | 21.0 | 18.1 |
| 1.0 | 26.2 | 25.4 |
| 2.0 | 46.3 | 41.0 |
| 5.0 | 80.3 | 75.0 |
| 10.0 | 87.5 | 84.2 |

Conclusions

Even at the high velocity of 140 ft./minute and the small percentage of charge control agent, positive efficiencies were achieved exemplified novelty both in charging and doping. Laser efficiency testing at lower air flows and higher concentrations of charge control agents will show a higher potential to capture smaller micron particles.

EXAMPLE 2

A standard acrylic adhesive binder was mixed with 2 percent polyacrylic acid to form a uniform mixture. The mixture was diluted with water, and then mixed with 6 and 15 denier fibers 2.5 ounces/sq.yd. and dried to form a sheet which was dried. This sheet was charged to approximately 1,000 volts. After 32 days the charge was measured at 1,000 volts positive charge as tested with a Volt Meter.

EXAMPLE 2A

Acrylic adhesive binder was mixed with the same fibers as Example 2 and dried to form a sheet. Fractional efficiency testing was conducted at 10.5 feet/minute media velocity.

| Efficiency Percentages | | |
|---|---|---|
| Micron Size | Charged Media Example 2 | Uncharged Media Example 2A |
| .3 | 0.8 | 0.1 |
| .5 | 2.0 | 0.6 |
| .7 | 9.5 | 0.9 |
| 1.0 | 26.0 | 12.0 |
| 2.0 | 44.0 | 15.5. |
| 5.0 | 57.5 | 26.6 |
| 10.0 | 82.5 | 77.1 |

Conclusions

With only 2 percent a small percentage of charge control agent, positive efficiencies were achieved in charging. Considerable change in efficiency is seen between 0.7 micron up to 10 micron.

EXAMPLE 3

Standard acrylic adhesive binder was mixed with 5 percent polyacrylic acid. The binder solution was mixed with water, and then sprayed bonded with 6 and 15 denier fibers (4.0 ounces/sq.yd.) and spray bonded to form a lofty sheet which was then dried. The sheet was charged with a cold charging method to approximately 1,000 volts. After 120 days, voltage measurement were recorded at 1,000 to 2000 volts positive charge tested with a Volt Meter.

EXAMPLE 3A

Example 3 was repeated with acrylic adhesive binder, Fractional efficiency testing was conducted at 10.5 feet/minute media velocity.

| Efficiency Percentages | | |
|---|---|---|
| Micron Size | Charged Media | Uncharged Media |
| .3 | 1.4 | 1.2 |
| .5 | 3.2 | 3.0 |
| .7 | 8.0 | 5.0 |
| 1.0 | 12.0 | 6.0 |
| 2.0 | 25.0 | 11.0 |
| 5.0 | 50.0 | 29.3 |
| 10.0 | 84.1 | 73.2 |

EXAMPLE 4

Polypropylene netting was mixed with 5% fumed silica to form a uniform dispersion and then formed into a netting. The netting was charged by a cold charging method.

EXAMPLE 4A

Standard polypropylene netting, same as above without any modification.

| Efficiency Percentages | | |
|---|---|---|
| Micron Size | Charged netting | Uncharged netting |
| .3 | 0.01 | 0.0 |
| .5 | 0.03 | 0.0 |
| .7 | 0.04 | 0.0 |
| 1.0 | 0.09 | 0.0 |
| 2.0 | 2.3 | 0.5 |
| 5.0 | 9.0 | 2.0 |
| 10.0 | 21.6 | 11.3 |

Conclusions

With 5% charge control agent, positive efficiencies were achieved in charging. Considerable change in efficiency is seen between 0.7 micron up to 10 micron.

Referring now to FIG. 1 the preferred 5-layer filter 10 contains a thinner (0.03 to 0.25 inches) middle layer 15. The layer can be a polymeric foam but usually is a high loft sheet of 0.1 denier to 40 denier polyester fibers bonded together by an acrylic resin adhesive which may or may not contain charge control agents (CCA). On each side of the middle layer 15 are sheets 13 of active or passive electrostatic netting. The outer 2 layers 11 are porous layers of a bendable material capable of holding the shape of the corrugations such as a tough polymer, a metal screen or expanded metal material.

Figure 2:
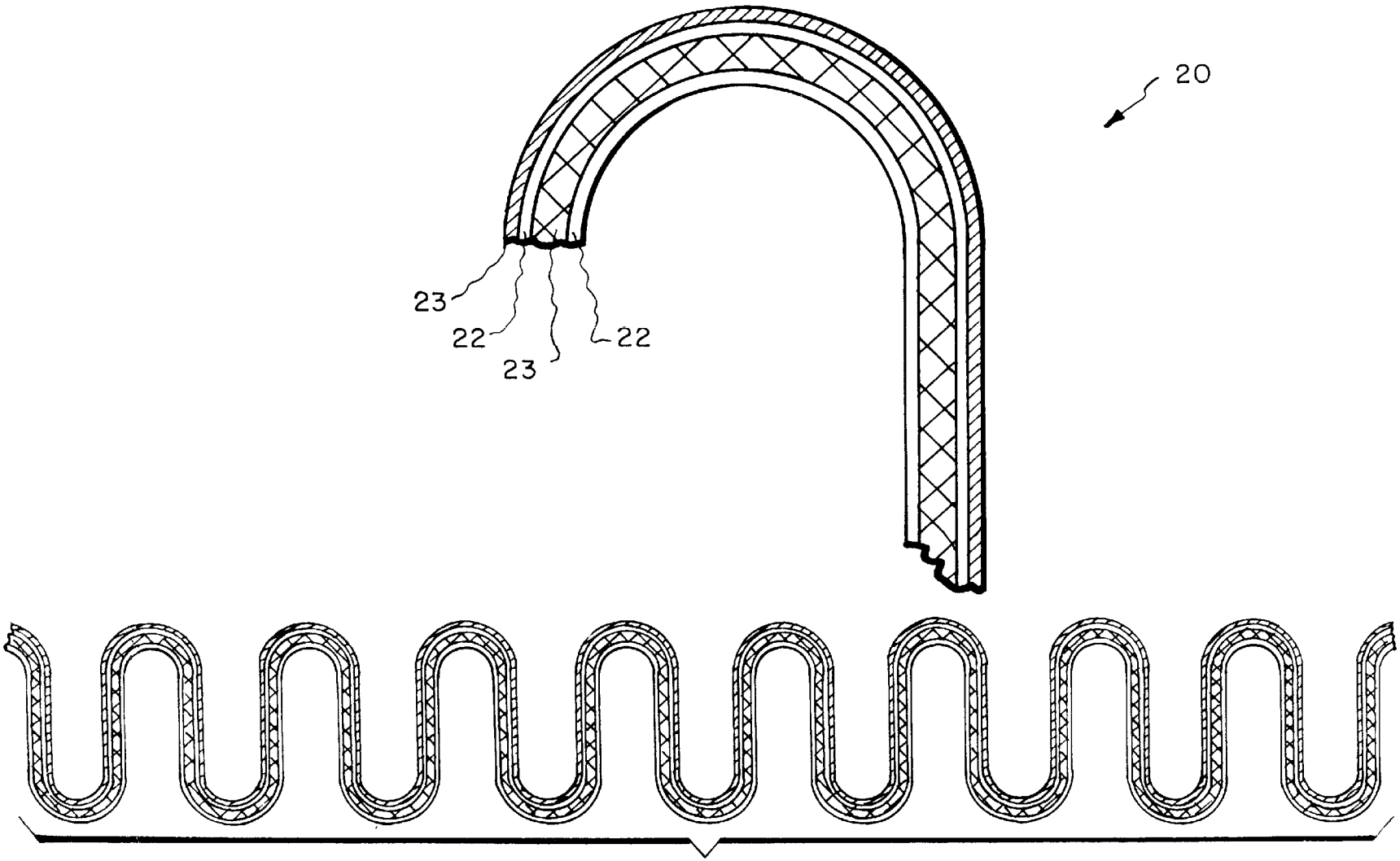
FIG. 2 is a view in section of a corrugation of a second embodiment of the filter of the invention.

A 2 or 4 layer filter 20 is illustrated in FIG. 2. The filter 20 is formed of a central layer 23 which may or may not contain CCAs, 2 passive or active polymeric netting layers 22 and one gas-permeable, bendable layer 23.

Figure 3:
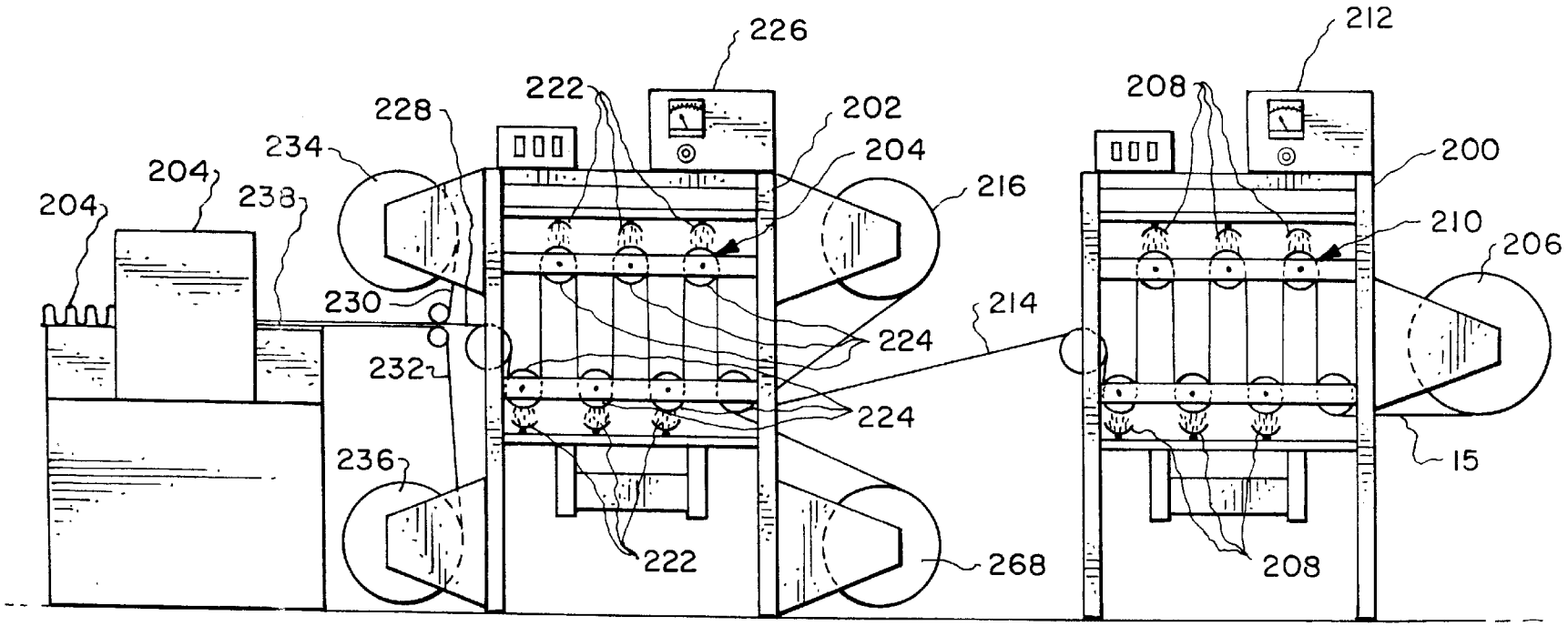
FIG. 3 is a schematic view of a corrugation and charging system according to the invention.
Figure 6:
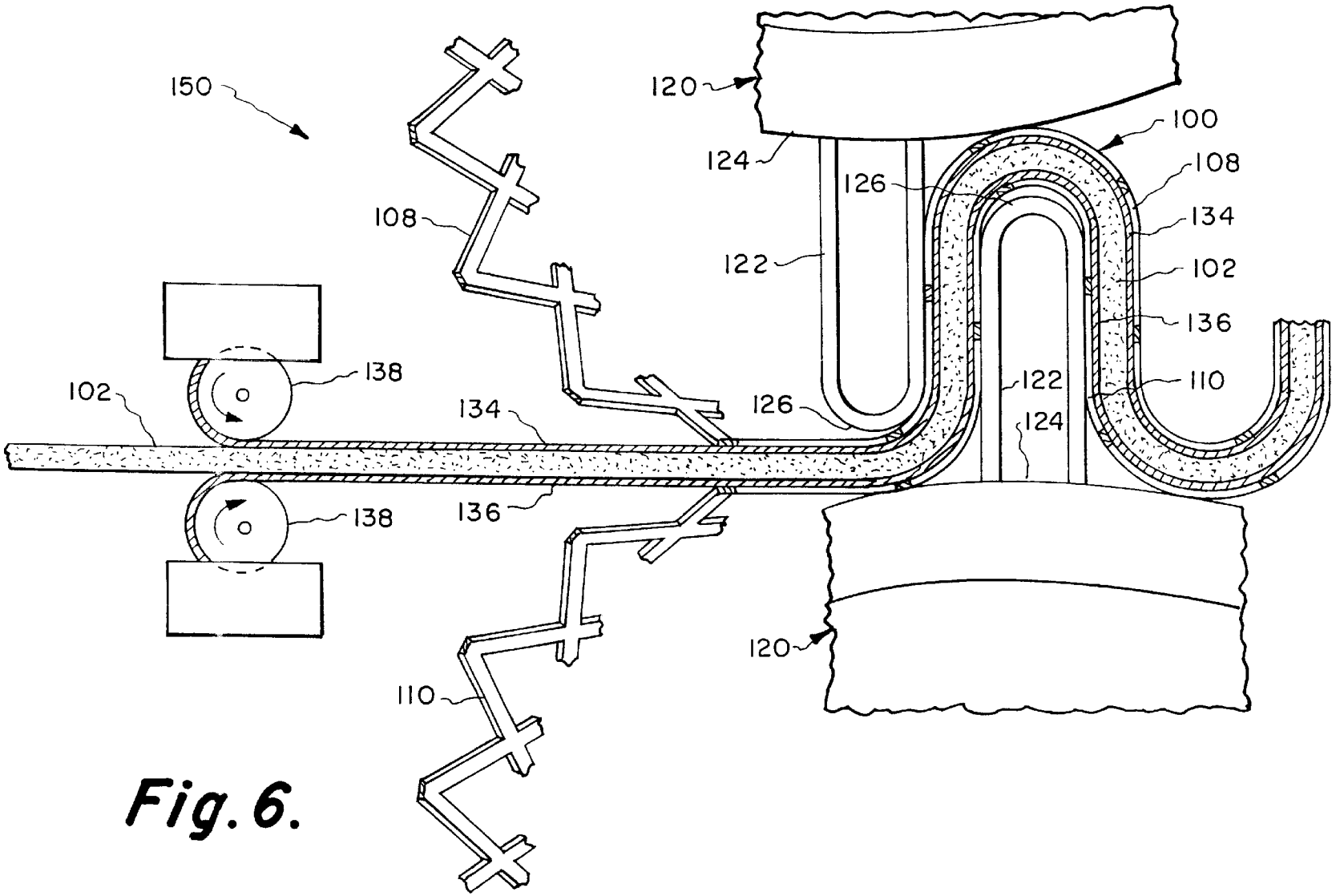
FIG. 6 is a schematic view of a continuous system for forming filter media according to the invention.

Referring now to FIG. 3 the filter media fabrication system includes a first charging station 200, a second charging station 202 and a corrugation unit 204 the details of which are illustrated in FIG. 6. The first charging station 200 receives a sheet 15 of the middle fibrous material 15 from roll supply 206.

The sheet 15 winds past 6 positive charge emitters 208 as it passes over rollers 210. The first charging station 200 contains a power supply—controller 212 for controlling power supplied to the positive ion emitters 208.

The positively charged central web 214 passes into the second charging station 202 and is combined with sheets 216, 268 of netting to form a 3 sheet assembly 220. The assembly 220 alternately passes past negative charge emitters 222 as it weaves through rolls 224. The second charging station also has a power supply—controller 226 for controlling and powering the emitters 222. As the charge 3-layer assembly 228 passes out of the second charging station 202 it is joined by sheets 230, 232 of stiff, forming material such as expanded metal screen from supply rolls 234, 236 to form a five sheet assembly 238. The assembly 238 is formed into corrugated media 240 in the corrugation unit 204.

Figure 4:
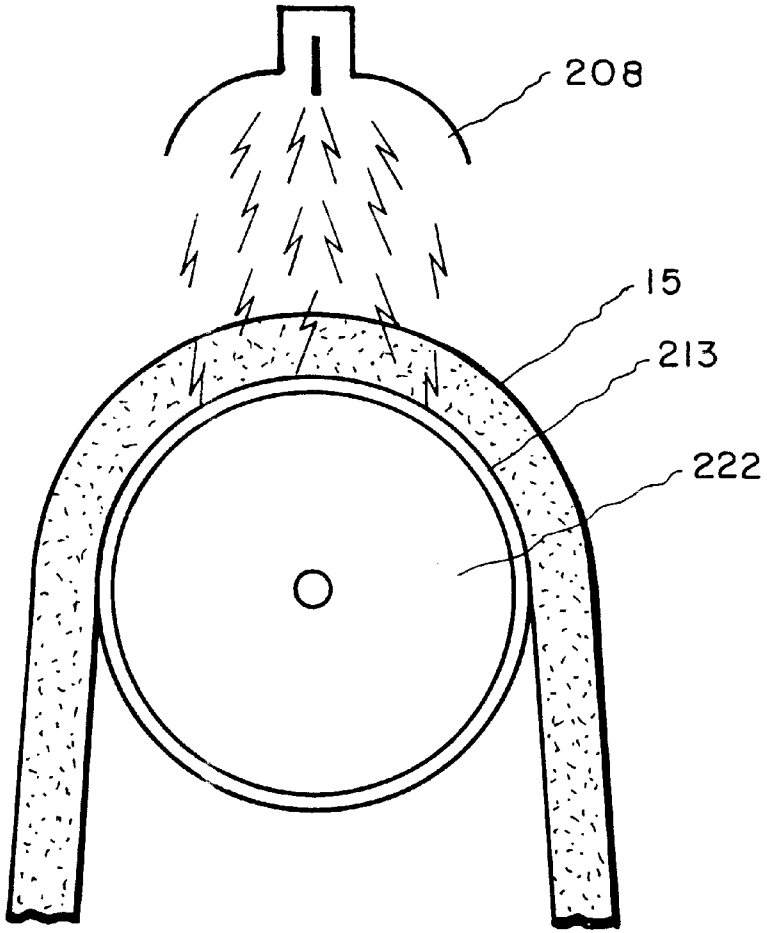
FIG. 4 is a side view of a charging station.

Referring now to FIG. 4, the web 15 is charged as it passes between the charge emitter 208 and a roller 222 having a conductive layer 213.

Figure 5:
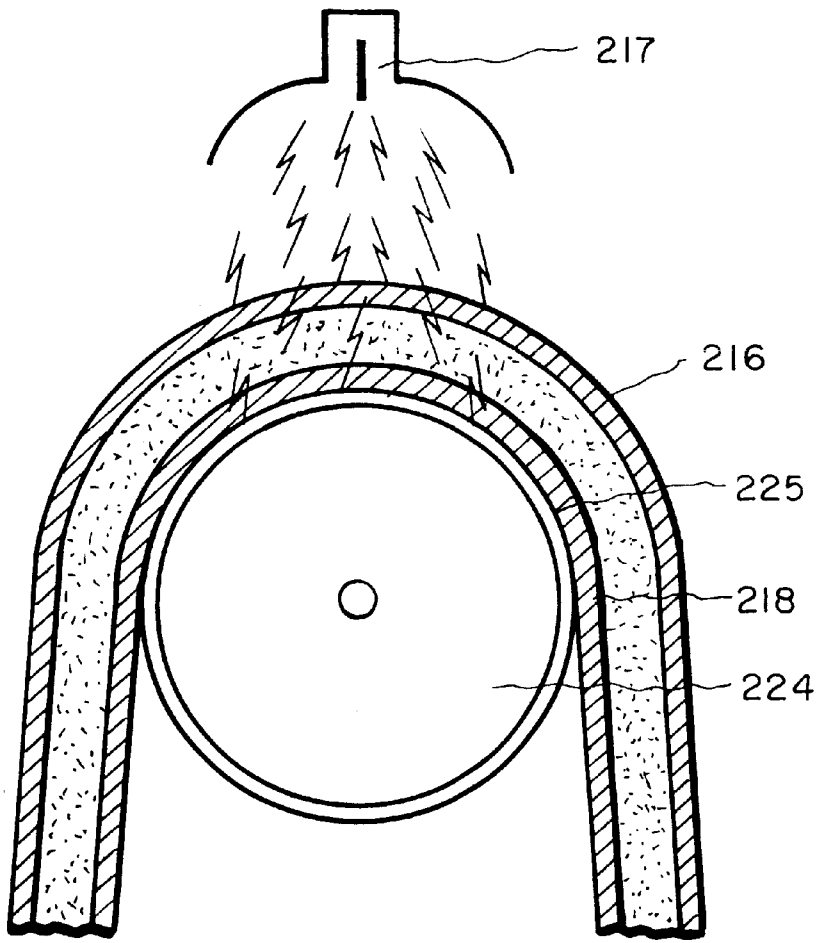
FIG. 5 is a side view of charge a multilayer composite filter according to the invention.

Referring now to FIGS. 3 and 5, the rollers 224 may also contain a conductive layer 225 to increase effectiveness of charging the sheets 216, 218 of electrostatic netting connected to a source 217 of charge opposite to that of the opposed negative or positive emitter 208, 222.

Another aspect of the invention is in the forming of the corrugations 150 of an embodiment of a five-layer assembly 100 as shown in FIG. 6. The central layer 102 is a thin, bendable foam or high loft polyester layer. The central layer 102 is covered with layers 134, 136 of the electrostatic netting from rollers 138. The outer open mesh expanded metal layer grills 108,and 110 complete the stack.

The grill layers 108 and 110 are added to the outer most sides before entering the forming corrugation operation. After forming the grill in the five-layer filter 100 the corrugation mechanical bonds these layers together and from returning to a flat condition. After the corrugation step, the filter is completed by securing a U-shaped metal channel, not shown, such as aluminum to the four edges of the assembly. An adhesive, preferably water-based, can be applied to the U-shaped channel to further secure the filter in place thereby preventing the corrugated folds from returning to a flat condition and dislodging from the frame.

The rollers 120 contains a plurality of offset V-shaped or U-shaped forming members 122 evenly spaced on the surface 124 of the roller 120 a distance apart sufficient to form a curved radius or V-shape in the media at the bottom of a corrugation. The sharp, pointed or rounded tops 126 of the forming members 122 form the inner pointed or rounded ends of the 5-layer corrugated assembly.

The active electrostatic washable, pleated filter of the invention exhibits better dust collection and need not rely on air flow to induce an electrostatic charge. The filter of the invention is actively charged during manufacture by charging the CCA's contained in the central layer and netting layer of the filter.

The filter of the invention is capable of being washed at least 10 times without significant loss of efficiency or active charge. It is preferred that the CCA's in the central layer be dispersed in the adhesive binder resin for the fibers and that the CCA's in the netting be dispersed in the polymer before extrusion. The embedding of the CCA's protect them during washing and protect them from losing their active charge.

It is to be realized that only preferred embodiments of the invention have been described and that numerous substitutions, modifications and alterations are permissible without departing from the spirit and scope of the invention as defined in the following claims.

What is claimed is:

1. A washable air filter for filtering inlet air to a heating and/or air conditioning system comprising in combination an assembly of:

a central active electrostatic pad containing actively charged charge control agents, said pad being selected from at least one of the group the group consisting of polymeric foam and bonded polymeric fibers, said pad having a high filtering efficiency for 10 micron and less particles, having a thickness from 0.01 to 0.45 inches, a density from 0.05 to 5.0 ounces per square yard, having an upstream and a downstream surface and being repeatedly washable with no significant loss in efficiency and in active charge;

a layer of porous, electrostatic polymeric material containing actively charged charge control agents disposed adjacent each of said surfaces; and a stiff open grill disposed adjacent each porous layer.

2. A washable air filter according to claim 1 in which the assembly is pleated, the grill is formed of metal and the angle between the wall surface adjacent pleats is from 0 degrees to 90 degrees.

3. A washable filter according to claim 1 in which the active charge of the pad is opposite the active charge of the porous layers.

4. A washable air filter according to claim 3 in which the porous layer is a polymeric net and the charge of the layer is negative.

5. A washable air filter according to claim 3 in which the porous layer is formed of a polymer of an alkyline containing 8 carbon atoms and the thickness of the porous layer is from 0.01 to 0.2 inches.

6. A washable air filter according to claim 4 in which the polymer of the netting contains a dispersion of finely divided silica charge control agent.

7. A washable filter according to claim 1 in which the central pad comprises bendable polyurethane foam.

8. A washable filter according to claim 1 in which the central pad comprises a web of polyester fibers adhered together by an adhesive binder resin.

9. A washable air filter according to claim 8 in which the binder resin is an acrylic resin.

10. A washable air filter according to claim 9 in which the acrylic binder resin contains a charge control agent.

11. A washable air filter according to claim 10 in which the charge control agent is positively charged.

12. A method of manufacturing a washable filter for filtering inlet air flow to a heating and/or air conditioning system comprising the steps of:

charging a polymer pad containing charge control agents and having high filtering efficiency for 10 micron and less particles to a first polarity to form a actively charged pad; and placing a layer of polymeric netting containing charge control agents of a second polarity adjacent each outer surface of the pad to form a first assembly;

charging the netting to an actively charged second polarity; and placing a stiff layer of porous material on each outer surface of the first assembly to form said air filter.

13. A method according to claim 12 further including the step of corrugating said air filter to form pleats in which the angle between wall surfaces of adjacent pleats is from 0 to 90 degrees.

14. A method according to claim 13 in which the charging steps are conducting as the pleat passes over a roller.

15. A method according to claim 14 in which the surface of the roller contains a layer of conductive elastomer.

16. A method according to claim 14 in which the air filter passes by charging stations of opposite polarity.

* * * * *